US009587359B1

(12) United States Patent
Yu

(10) Patent No.: US 9,587,359 B1
(45) Date of Patent: Mar. 7, 2017

(54) SNOW REMOVAL APPARATUS

(71) Applicant: Ching-Chih Yu, Changhua (TW)

(72) Inventor: Ching-Chih Yu, Changhua (TW)

(73) Assignee: Lilun Plastics Enterprise Co Ltd., Changhua (TW)

( * ) Notice: Subject to any disclaimer, the term of this patent is extended or adjusted under 35 U.S.C. 154(b) by 0 days.

(21) Appl. No.: 15/175,979

(22) Filed: Jun. 7, 2016

(51) Int. Cl.

| | |
|---|---|
| ***A01B 1/00*** | (2006.01) |
| ***A01D 9/00*** | (2006.01) |
| ***A01D 11/00*** | (2006.01) |
| ***E01H 5/02*** | (2006.01) |

(52) U.S. Cl.
CPC ..... *E01H 5/02* (2013.01)

(58) Field of Classification Search
CPC .... E01H 5/02; E01H 5/00; A01B 1/02; A01B 1/026; B25G 3/02
USPC ..... 294/49, 54.5, 57–59, 178
See application file for complete search history.

(56) References Cited

U.S. PATENT DOCUMENTS

| | | | | | |
|---|---|---|---|---|---|
| 4,538,847 | A * | 9/1985 | Lapshansky | A01B 1/222 | 294/51 |
| D363,653 | S * | 10/1995 | Tisbo | D8/10 | |
| 5,676,413 | A * | 10/1997 | Hauck | E04D 13/106 | 294/54.5 |
| 6,018,894 | A * | 2/2000 | Whitehead | E04D 13/106 | 294/54.5 |
| D477,194 | S * | 7/2003 | Markley | D8/10 | |
| 8,070,198 | B2 * | 12/2011 | Burke | B25G 3/38 | 294/51 |
| 9,120,217 | B2 * | 9/2015 | Fischer, Jr. | B25G 1/04 | |
| 2011/0115242 | A1 * | 5/2011 | McNab | E01H 5/02 | 294/54.5 |

* cited by examiner

*Primary Examiner* — Stephen Vu
(74) *Attorney, Agent, or Firm* — Che-Yang Chen; Law Offices of Scott Warmuth

(57) ABSTRACT

A snow removal apparatus may include a main body, an engaging base, a shaft and two brackets and be applied to different situations to achieve the effect of removing snow by pulling or pushing the shaft thereof such that a user has no need to repetitively shovel and lift snow to a trolley thus saving time and labors. Also, the snow removal apparatus can remove larger amounts of snow to a great distance without the trolley thus improving applicability. Moreover, since the snow removal apparatus has multi-function, the user can only buy one tool to achieve the effect of removing snow which lowers the cost and is easier for storage.

6 Claims, 8 Drawing Sheets

SNOW REMOVAL APPARATUS

FIELD OF THE INVENTION

The present invention relates to a snow removal apparatus and more particularly to a snow removal apparatus with the functions of shaving and pushing snow.

BACKGROUND OF THE INVENTION

In high latitude regions, the weather is cooler and the moisture is relative sufficient to snow, and the fallen snow is prone to become snow pack covered on the ground thereby interfering people in traffic or other situations. Thus, removing the snow is important for people living in these regions.

A user usually holds a shaft of a snow removal apparatus as a supporting point and using a blade portion of the apparatus formed at lower end thereof to shovel and remove the snow.

However, the conventional snow removal apparatus has following disadvantages: (i) for removing snow, a user needs to take a huge physical effort to use the tool, and the efficiency of removing snow is insufficient; and (ii) if the snow needs to be moved to a designated place, other tools such as a trolley must be used to achieve the action which is inconvenient and might cost unnecessary time and money. Therefore, there remains a need for a new and improved design for a snow removal apparatus to overcome the problems presented above.

SUMMARY OF THE INVENTION

The present invention provides a snow removal apparatus which comprises a main body, an engaging base, a shaft and two brackets. The main body has a curved blade which comprises a concave surface and a convex surface. The blade comprises an opening formed at an opposing side of the convex surface, and a connecting base is formed and protrudes from an upper edge of the concave surface. The engaging base is mounted on a central portion of the convex surface, and a connecting hole and an engaging hole are respectively formed on the connecting base and the engaging base. The shaft comprises a connecting end and a holding end, and the connecting end is selectively inserted and secured in the connecting hole or the engaging hole to connect the shaft with the main body thus allowing a user to shovel or push snow in different situations. Two lateral sides of the shaft are respectively connected to two first ends of the two brackets while two second ends of the two brackets are respectively connected to the main body thereby enhancing the structural strength and allowing the main body and the shaft to endure more pushing or pulling force, and wherein the connections between the two brackets and the main body and between the two brackets and the shaft are detachable.

Comparing with conventional snow removal apparatus, the present invention is advantageous because: (i) the present invention can be applied to different terrains to achieve the effect of removing snow by pulling or pushing the shaft thereof such that the user has no need to repetitively shovel and lift snow to the trolley thus saving time and labors; (ii) the snow removal apparatus in the present invention can remove larger amounts of snow to a great distance without the trolley thus improving applicability; and (iii) since the snow removal apparatus has multi-function, the user can only buy one tool to achieve the effect of removing snow which lowers the cost and is easier for storage.

DETAILED DESCRIPTION OF THE INVENTION

Figure 1:
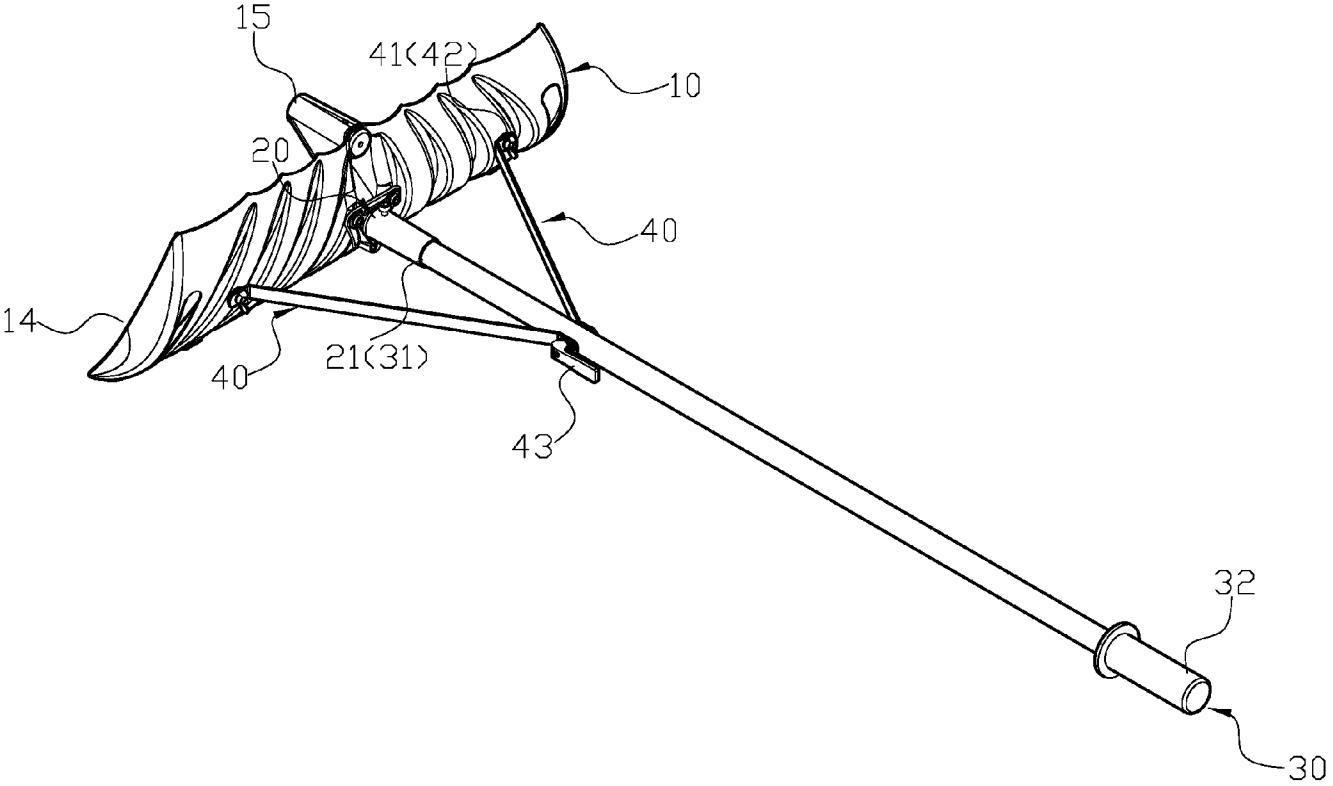
FIG. 1 is a three-dimensional assembly view of a snow removal apparatus in the present invention.
Figure 2:
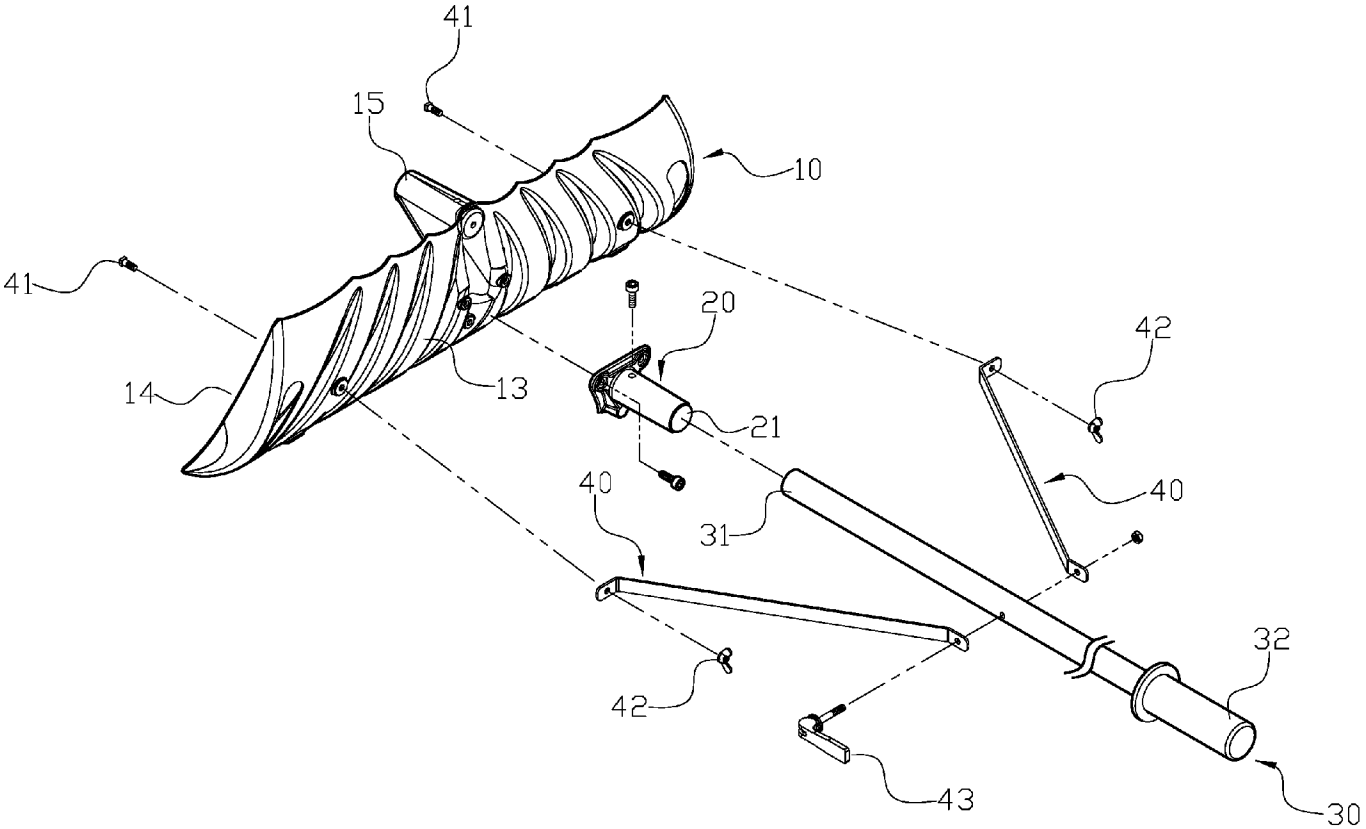
FIG. 2 is a three-dimensional exploded view of the snow removal apparatus in the present invention.
Figure 3:
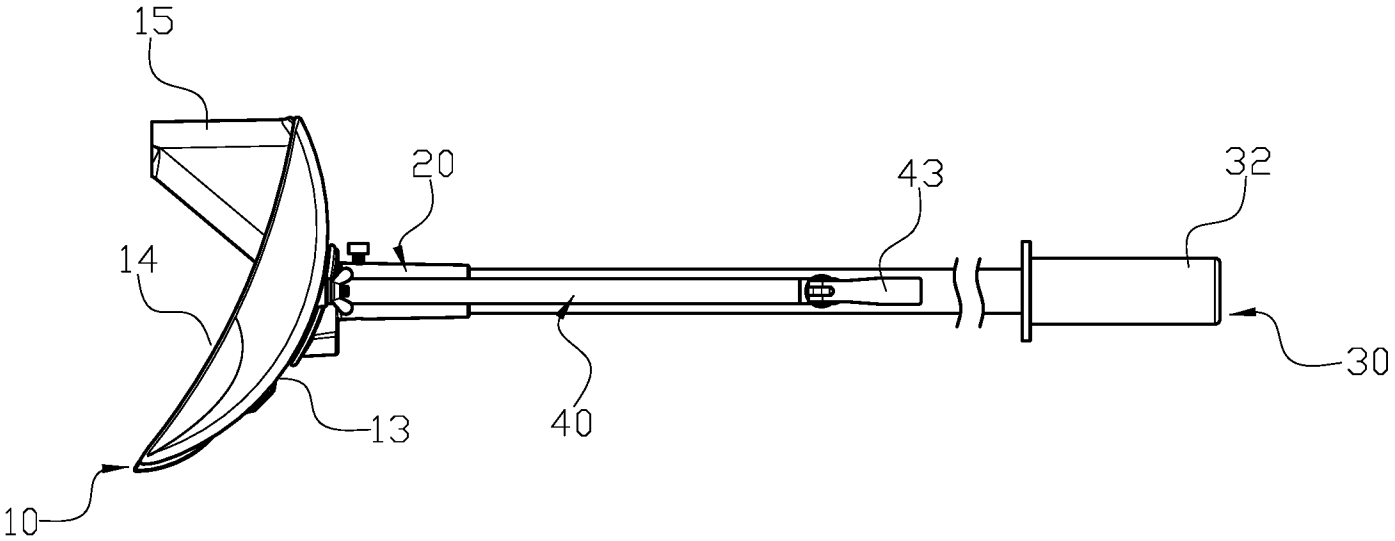
FIG. 3 is a plane assembly view of the snow removal apparatus in the present invention.
Figure 4:
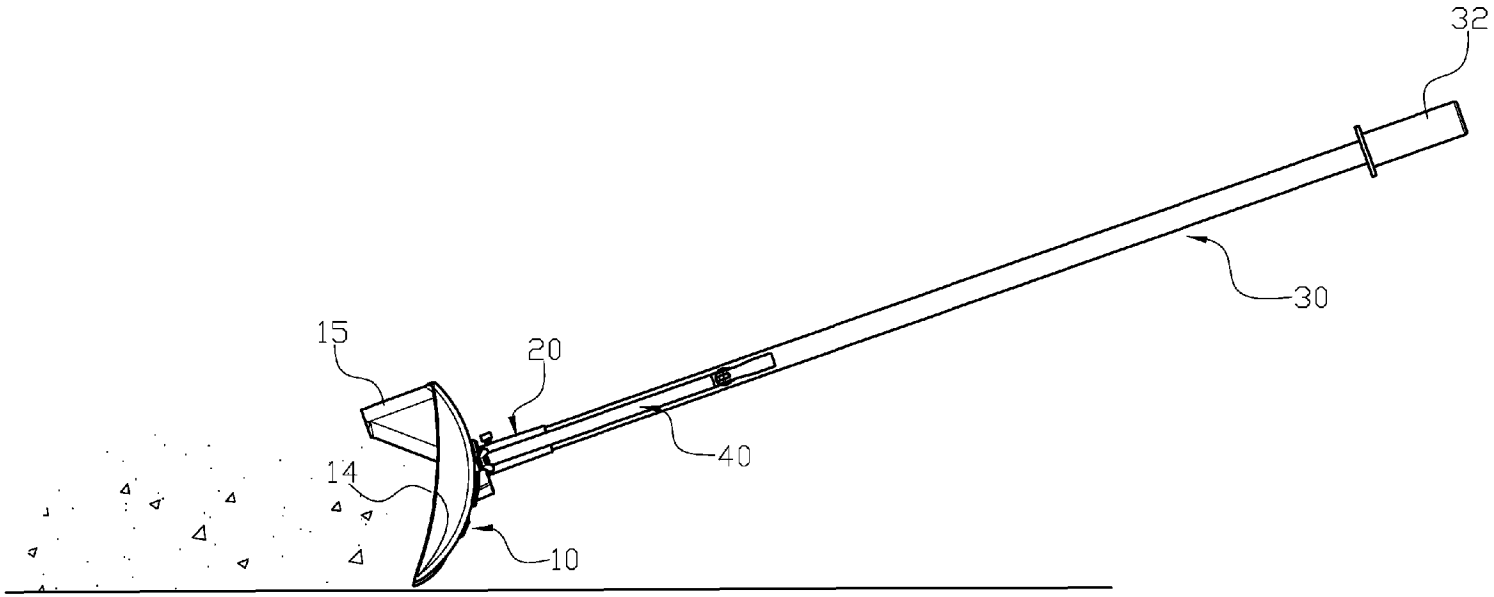
FIG. 4 is a side view illustrating the snow removal apparatus in the present invention is in use.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 3, 5 and 7, the present invention provides a snow removal apparatus which comprises a main body (10), an engaging base (20), a shaft (30) and two brackets (40). The main body (10) has a curved blade (11) which comprises a concave surface (12) and a convex surface (13). The blade (11) comprises an opening (14) formed at an opposing side of the convex surface (13), and a connecting base (15) is formed and protrudes from an upper edge of the concave surface (12). The engaging base (20) is mounted on a central portion of the convex surface (13), and a connecting hole (16) and an engaging hole (21) are respectively formed on the connecting base (15) and the engaging base (20). The shaft (30) comprises a connecting end (31) and a holding end (32), and the connecting end (31) is selectively inserted and secured in the connecting hole (16) or the engaging hole (21) to connect the shaft (30) with the main body (10) thus allowing a user to shovel or push snow in different situations. Two lateral sides of the shaft (30) are respectively connected to two first ends of the two brackets (40) while two second ends of the two brackets (40) are respectively connected to the main body (10) thereby enhancing the structural strength and allowing the main body (10) and the shaft (30) to endure more pushing or pulling force, and wherein the connections between the two brackets (40) and the main body (10) and between the two brackets (40) and the shaft (30) are detachable.

Wherein a bottom portion of the connecting base (15) located on the concave surface (12) is formed in a taper shape, wherein a tip end of the bottom portion is located at an edge of the concave surface (12) and an expanded end thereof is located at a central portion of the concave surface (12).

Wherein the connecting base (15) and the main body (10) are formed integrally.

Wherein the engaging base (20) is mounted on the convex surface (13) of the main body (10) by using screws.

Wherein the second ends of the two brackets (40) are secured on the main body (10) by using a screw (41) and a nut (42), and the first ends of the two brackets (40) are secured on the shaft (30) by using a quick release skewer (43). Wherein the nut (42) e.g. a wing nut, can be tightened by hand.

Wherein the concave surface (12) comprises a plurality of ribs.

Wherein the connecting end (31) of the shaft (30) is configured to selectively insert into the connecting hole (16) or the engaging hole (21) and is secured on the connecting base (15) or the engaging base (20) by using screws.

Figure 5:
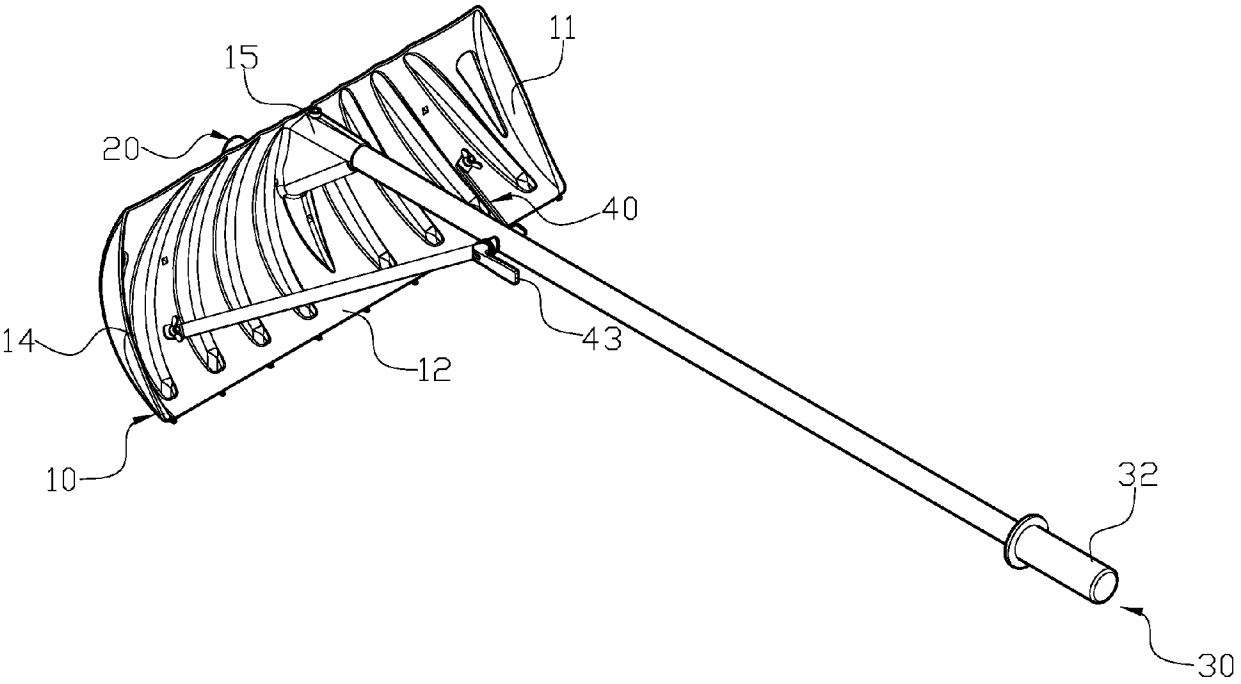
FIG. 5 is a three-dimensional assembly view of another embodiment of the snow removal apparatus in the present invention.
Figure 6:
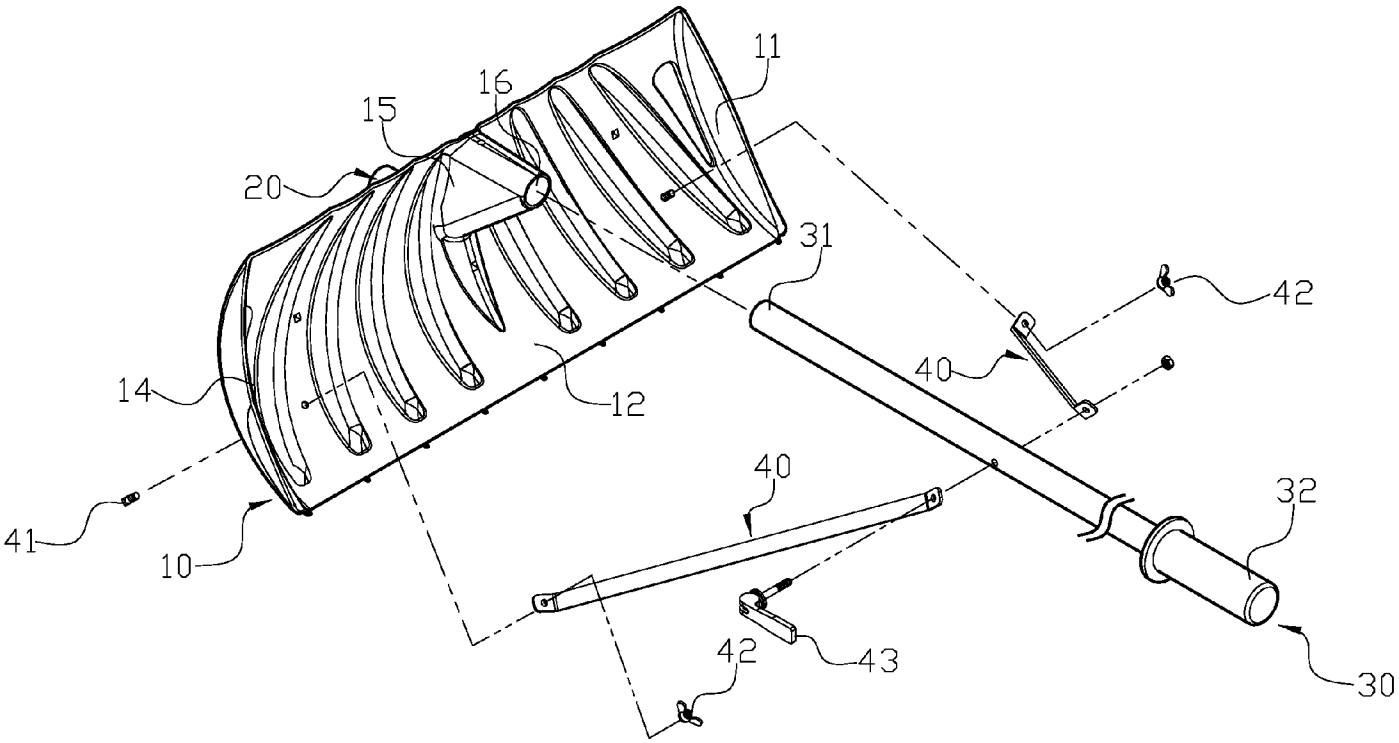
FIG. 6 is a three-dimensional exploded view of another embodiment of the snow removal apparatus in the present invention.
Figure 7:
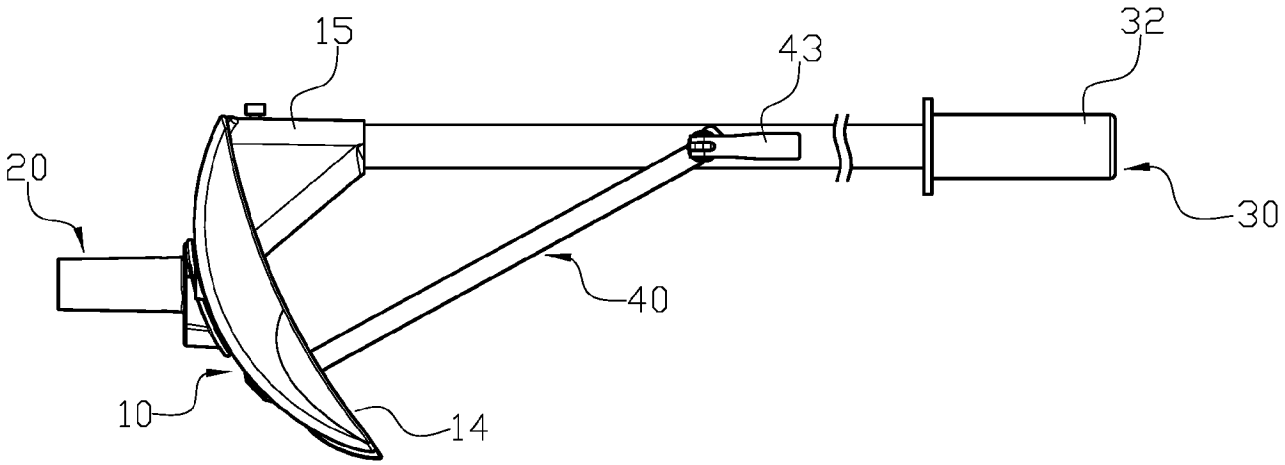
FIG. 7 is a plane assembly view of another embodiment of the snow removal apparatus in the present invention.
Figure 8:
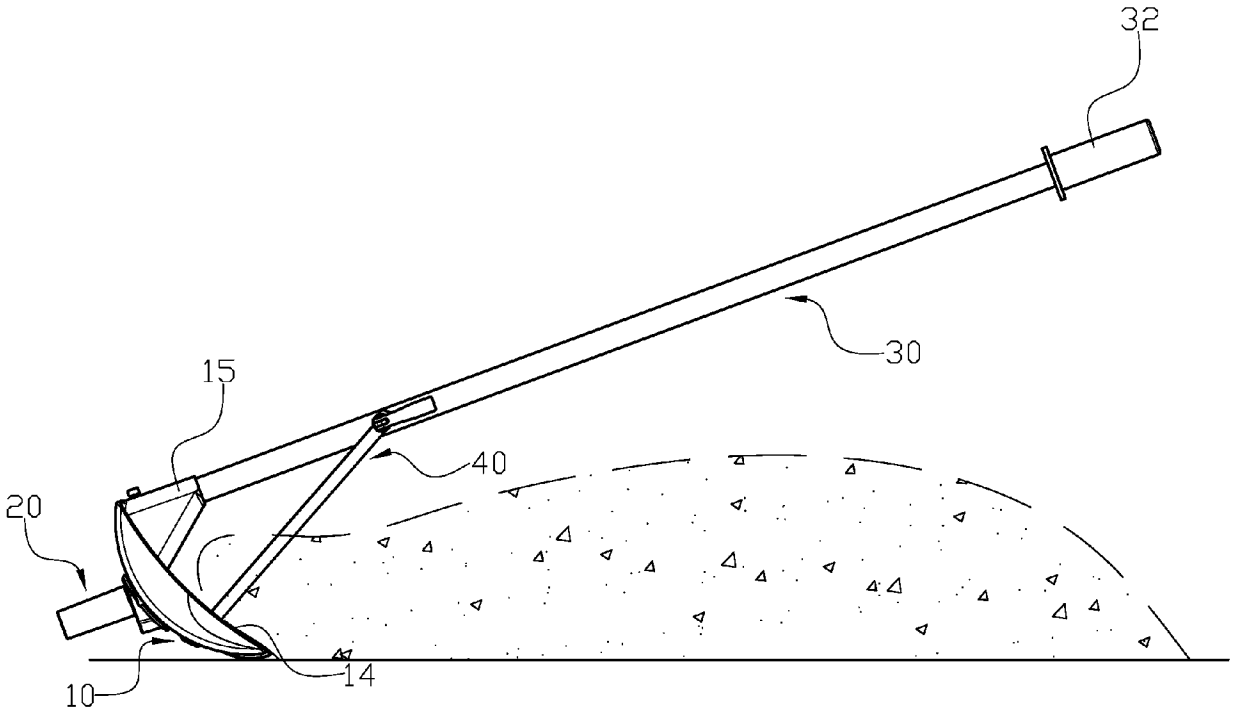
FIG. 8 is a side view of another embodiment illustrating the snow removal apparatus in the present invention is in use.

In actual application, for pushing snow out of a designated place, the connecting end (31) of the shaft (30) is inserted and connected to the engaging hole (21) of the engaging base (20) to allow the opening (14) to face snow packed on the ground, and a user can use the concave surface (12) to push snow thus achieving the effect of removing snow (as shown in FIGS. 1 to 4). In this manner, the user has no need to repetitively shovel snow and to use a trolley to transport and take out the shoveled snow thus saving time and labors. Also, when snow cannot be removed by a manner of pushing. The connecting end (31) of the shaft (30) can be inserted and connected to the connecting hole (16) of the connecting base (15) (as shown in FIGS. 5 to 7) to allow the opening (14) to locate at the same side with the shaft (30) such that the user can shave and remove snow by pulling the shaft (30) (as shown in FIG. 8).

Comparing with conventional snow removal apparatus, the present invention is advantageous because: (i) the present invention can be applied to different situations to achieve the effect of removing snow by pulling or pushing the shaft (30) such that the user has no need to repetitively shovel and lift snow to the trolley thus saving time and labors; (ii) the snow removal apparatus in the present invention can remove larger amounts of snow to a great distance without the trolley thus improving applicability; and (iii) since the snow removal apparatus has multi-function, the user can shave and push snow by simply buying one tool to achieve the effect of removing snow which lowers the cost and is easier for storage.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A snow removal apparatus comprising:

a main body having a curved blade which comprises a concave surface and a convex surface, and an opening of the main body formed at an opposing side of the convex surface, a connecting base protruding from an upper edge of the concave surface, and an engaging base mounted on a central portion of the convex surface, and a connecting hole and an engaging hole respectively formed on the connecting base and the engaging base; and a shaft comprising a connecting end and a holding end, and the connecting end configured to selectively insert and secure in the connecting hole or the engaging hole thereby connecting the shaft to the main body and allowing a user to use the snow removal apparatus to shave or push snow in different situations, two lateral sides of the shaft respectively connected to two first ends of two brackets while two second ends thereof respectively connected to the main body thereby enhancing the structural strength and allowing the main body and the shaft to endure a greater pushing or pulling force, wherein the connections between the two brackets and the main body and between the two brackets and the shaft are detachable, wherein a bottom portion of the connecting base located on the concave surface is formed in a taper shape, and a tip end of the bottom portion is located at a long edge of the concave surface while an expanded end thereof is located on the concave surface.

2. The snow removal apparatus of claim 1, wherein the connecting base and the main body are formed integrally.

3. The snow removal apparatus of claim 1, wherein the engaging base is mounted on the convex surface of the main body by using screws.

4. The snow removal apparatus of claim 1, wherein the two second ends of the two brackets are secured on the main body by using screw-nut pairs, and the two first ends of the two brackets are secured on the shaft by using a quick release skewer.

5. The snow removal apparatus of claim 4, wherein the nuts of the screw-nut pairs are configured to be tightened by hand.

6. The snow removal apparatus of claim 1, wherein a plurality of ribs are formed on the concave surface of the main body.

* * * * *